US005916118A

United States Patent [19]

Wassenhoven et al.

[11] Patent Number: 5,916,118

[45] Date of Patent: Jun. 29, 1999

[54] DEVICE FOR PREPARING A PIECING PROCESS IN AN OPEN-END SPINNING MACHINE

[75] Inventors: Heinz-George Wassenhoven; Jochen Dressen, both of Monchen-Gladbach, Germany

[73] Assignee: W. Schlafhorst AG & Co., Monchen-Gladbach, Germany

[21] Appl. No.: 09/035,402

[22] Filed: Mar. 5, 1998

[30] Foreign Application Priority Data

Mar. 10, 1997 [DE] Germany ..... 197 09 747

[51] Int. Cl.[6] ..... D01H 13/26

[52] U.S. Cl. ..... 57/263; 57/301; 57/302; 57/304; 57/406; 57/407; 57/415

[58] Field of Search ..... 57/263, 301, 302, 57/304, 406, 407, 415

[56] References Cited

U.S. PATENT DOCUMENTS

| | | | |
|---|---|---|---|
| 4,038,812 | 8/1977 | Stahlecker | 57/411 |
| 4,069,654 | 1/1978 | Roehrich | 57/407 |
| 4,485,616 | 12/1984 | Morita et al. | 57/263 |
| 4,487,012 | 12/1984 | Horiuchi et al. | 57/263 |
| 4,676,060 | 6/1987 | Stahlecker et al. | 57/263 |
| 5,640,839 | 6/1997 | Novotny et al. | 57/304 |
| 5,732,543 | 3/1998 | Bungter et al. | 57/406 |
| 5,749,213 | 5/1998 | Stephen | 57/304 |

FOREIGN PATENT DOCUMENTS

| | | |
|---|---|---|
| 24 10 269 A1 | 9/1975 | Germany . |
| 28 18 794 A1 | 11/1979 | Germany . |
| 41 31 684 A1 | 3/1993 | Germany . |
| 44 45 740 A1 | 6/1996 | Germany . |

*Primary Examiner*—William Stryjewski
*Attorney, Agent, or Firm*—Kennedy Covington Lobdell & Hickman, LLP

[57] ABSTRACT

So that stray fibers do not become attached to the rotor during a yam piecing process in the spinning box of a rotor spinning machine, the rotor may be cleaned by an air flow generated by drawing air into the rotor by the prevailing spinning vacuum or by blowing compressed air into the rotor through a closable opening in the rotor chamber. To avoid the danger that soiling of the closure of the opening will permit aspiration of secondary air and impair control of the air supply, the closure is formed as a slide member with a leading edge configured for cleaning the opening during closing movement.

9 Claims, 6 Drawing Sheets

DEVICE FOR PREPARING A PIECING PROCESS IN AN OPEN-END SPINNING MACHINE

FIELD OF THE INVENTION

The present invention relates generally to a spinning box at a spinning station of an open-end spinning machine and, more particularly, to a spinning box having a spinning chamber to which a spinning vacuum is applied and in which a spinning rotor turns at high speed (rpm), and having a cover enclosing the rotor at a front side and supporting means for feeding fibers from a sliver to the rotor and a yarn withdrawal tube for drawing spun yarn out of the rotor. The present invention has particular application to the provision of an opening in the spinning box cover for air supply and to a closure therefor which can be actuated during the preparation and operation of the piecing process by means of a service unit performing the piecing process.

BACKGROUND OF THE INVENTION

If the yarn is broken at a spinning station of an open-end rotor spinning machine, or when spinning is to commence at a spinning station, a trailing yarn end is brought back through the yam draw-off tube to the rotor in the respective spinning station, so that it can be combined therein with the fibers fed into the rotor. The spinning process starts with continuous feeding of fibers and drawing off the yarn. The insertion of the yarn into the rotor, as well as the feeding of the fibers, must be exactly matched to each other, so that the area of the pieced section does not differ in appearance or quality from the remaining yarn in an impermissible manner.

A piecing process requires particular care when feeding the fibers. If a yarn breaks, the sliver feed is immediately stopped. As a rule, the yarn is pulled out of the spinning chamber and therefore out of the rotor by means of the high winding speed. It is customary to clean the rotor prior to each piecing process before the yarn is returned into the spinning chamber. This measure is for the preventative purpose of increasing the quality of the yam and is intended to remove dirt which has collected in the rotor, as well as fibers which would hamper the piecing process. However, during this process the sliver being fed remains inserted in the opening device, and the opening roller continues to turn with the spinning vacuum being continuously applied to the spinning chamber. Thus, it cannot be ruled out that, after a cleaning process has been performed and while the stopped rotor awaits the piecing process, fibers are being transported in the direction toward the rotor and collect at the lowest point in the fiber collection trough of the rotor. These uncontrolled fibers flying around in the spinning chamber can form flocks in the yarn when being deposited on the rotor and can therefore trigger yarn faults. For this reason it is important that no stray fibers can get caught in the rotor prior to the piecing process. In order to be able to perform piecing and yarn formation without interfering fibers, it is known from German Patent Publication DE 44 45 740 A1 to generate an air flow in the spinning chamber by opening a flap, and to maintain this air flow until the speed (rpm) of the rotor has reached a value in which the centrifugal force of the fibers causes a deposition of the fibers in the rotor trough, which can no longer be affected by the airflow.

It is also known from German Published, Non-Examined Patent Application DE-OS 28 18 794 to influence the vacuum in the spinning chamber during the piecing process by opening a flap at an air supply opening of the spinning chamber, in order that, prior to feeding in fibers for piecing, the rotor is freed from fibers which have already been deposited therein, and so that the feeding speed of the fibers fed to the piecing device can be matched to the rotor rpm. Fibers and dirt, which adhere to the rim of the opening or have been caught when the flap was closed, can be aspirated from the vicinity through an opening unblocked by a flap. The deposition of dirt is made easier in particular by fibers carrying gummy or sticky substances. If the flap is prevented from closing completely, secondary airflows can occur in the spinning chamber, which have a negative effect on the feeding of the fibers to the rotor and thus on the spinning process.

It is further known from the earlier filed, but later published German Patent Publication DE 196 24 537 A1 to blow compressed air centrally into the rotor cup for the purpose of blowing out fibers interfering with the spinning process through an exhaust nozzle for the yarn located opposite the rotor. A valve which blocks a compressed air feed line is provided to this end in the cover over the spinning chamber, sometimes referred to as a hood. The valve consists of a sphere which is pressed against a sealing face by means of a spring acting counter to the spinning vacuum. The sphere is lifted off the sealing face by the effect of the compressed air flowing into the rotor cup, and the compressed air flows through the exhaust nozzle into the rotor. If fibers and dust on the sealing face prevent the complete seating of the sphere, secondary air can flow through the valve during the spinning process. If fibers and dust cling to the spring and in this way reduce its resiliency, a controlled air supply is no longer possible.

SUMMARY OF THE INVENTION

It is accordingly an object of the present invention to provide an improved means for optimally controlling the air supply within the spinning box of an open-end spinning, in particular for cleaning the rotor when preparing and performing a yarn piecing process. A more particular object of the present invention is to control the air supply via a closable opening in the spinning box and to prevent the admission of secondary air during spinning.

The present invention is basically adapted for a spinning station of an open-end spinning machine wherein a spinning box comprises a spinning chamber, means for applying a spinning vacuum within the chamber, a rotor disposed rotatably within the chamber, and a cover enclosing the spinning chamber. The cover has means for feeding fibers to the rotor, means for withdrawing spun yarn out of the rotor, an opening for supplying air into the chamber, and, in accordance with the present invention, a slide member for opening and closing the air supplying opening during a yarn piecing operation by means of a service unit for performing the piecing operation. Such service unit preferably includes a manipulator having a profiled element movable relative to the spinning station and the slide member includes an actuating element disposed in the path of movement of the profiled element so that the opening and closing disposition of the slide member can be changed as a function of the movement of the profiled element.

The deposition of dirt at the opening, which hampers the functional ability of the closure and allows secondary air to be admitted into the rotor, is effectively prevented by closing the opening by means of a slide member for the controlled supply of air to the spinning chamber of the spinning box in accordance with the present invention. In particular, the closing movement of a slide member over the rim of the opening constituting the sealing face has a cleaning effect, because dirt possibly deposited on the sealing face is stripped off, and in this way the desired function of the slide member for tightly sealing the opening is assured.

The slide member can be actuated by a service unit which also performs the piecing process. For example, the actuation of the slide member can take place by means of a manipulator, which is placed at the spinning station in order to feed the sliver to the spinning station during the piecing process. The slide member has an actuating element, which can be arranged in the movement path of a profiled surface of the manipulator, so that the opening position of the slide member is a function of the placement movement of the manipulator. But the manipulator can also have an actuator, which can be triggered independently of the movement of the manipulator and can be brought into operative connection with the actuating element of the slide member. It is also possible to actuate the slide member by means of a blower nozzle, which can be placed at the opening for preparing the piecing process. In this case the blower nozzle has a profile which, for opening the slide member, acts on the actuating element thereof.

A slide member offers the advantage over known closure elements of being able to be placed into any selected opening position. It is possible by means of this to selectively adjust the uncovered cross section of the opening and therefore to change the intensity of the airflow continuously and to adapt it to the respective prevailing requirements, for example as a function of the rotor diameter and the yarn parameters.

The cleaning function of the slide member is aided by providing a front edge of the slide member with a profile which cleans the rim of the opening in the course of a closing process. For example, viewed in the direction of closing movement of the profile, the profile can terminate in a wedge-like point like a scraper. In order to protect the rim of the opening constituting the sealing face from damage and to better match the profile of the slide member, the front edge of the cleaning profile of the slide member can be made of an elastic material, for example a plastic or hard rubber material or the like. Because of possible wear it is furthermore advantageous to fasten the cleaning profile of the slide member exchangeably at its front edge. Fastening can be accomplished by clamping or screwing, for example.

To aid the closing movement of the slide member after it has been activated, it is advantageous if the slide member is connected with an automatically acting restoring device for returning to its closing position. The restoring device can additionally contribute to stabilizing the position of the slide member in the course of selectively varying the opening cross section for controlling the airflow.

The sealing effect of the slide member against the admission of secondary air during spinning is considerably increased if the slide member is covered with a diaphragm on its surface facing the opening. When the slide member is closed, the diaphragm is pulled by suction against the opening to be held in contact with its edge under the effect of the spinning vacuum prevailing at the opening. In this way the opening is advantageously completely sealed against any admission of air.

According to a further aspect of the invention, the opening on the spinning box can be designed to receive a compressed air nozzle, which can be advanced when the slide member has released the opening. Particularly effective cleaning takes place because of the increased pressure and the higher flow speed of compressed air in comparison to suction air created by the spinning vacuum. Cleaning of the rotor by means of compressed air centrally blown into the rotor is described, for example, in German Patent Publication DE 196 24 537 A1.

Additional features, objects and advantages of the present invention will be explained in more detail hereinbelow with reference to exemplary embodiments illustrated in the accompanying drawings.

DETAILED DESCRIPTION OF THE PREFERRED EMBODIMENTS

Figure 1:
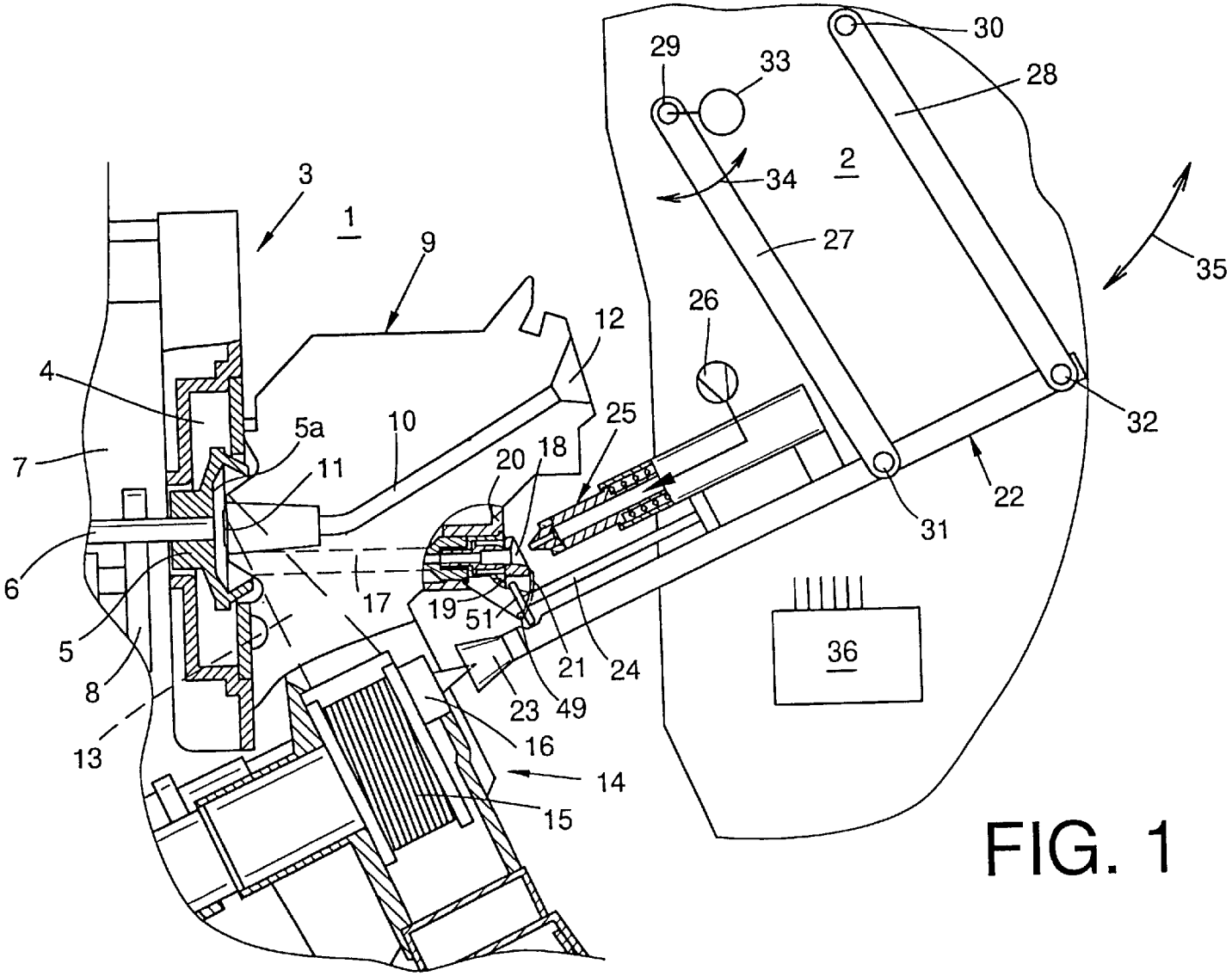
FIG. 1 is a side elevational view, partially in cross-section, of one spinning station of a multi-station open-end spinning machine in accordance with a preferred embodiment of the present invention, depicted with a service unit positioned at the front of the station to place a manipulator with a compressed air nozzle against the spinning box for sliver draw-in as well as for actuating the slide member of the present invention.

Referring now to the accompanying drawings and initially to FIG. 1, a portion of a spinning station of an open-end rotor spinning machine is illustrated and indicated generally at 1. A travelling service unit 2 is positioned in front of the spinning station 1, of which only the features necessary for aiding in understanding the present invention are represented. The spinning station 1 has a spinning box 3 defining a spinning chamber 4 in which a rotor 5 is rotatably supported. The spinning chamber 4 is connected to a vacuum source, not represented here, for maintaining a spinning vacuum within the rotor 5. The rotor 5 is mounted on a drive shaft 6 which is supported in a housing 7 of the spinning box 3 in a disk bearing comprised of spaced disk pairs which define therebetween a wedge-like notch or gap for receiving the shaft 6 as is known from the prior art. One disk 8 of the disk bearing in which the shaft 6 of the rotor 5 is seated can be seen. The spinning chamber 4 is closed by means of a cover, in the form of a hood 9, in which a yarn withdrawal tube 10 is supported to extend from a yarn draw-off nozzle 11 located opposite the rotor 5, to a remote outlet opening 12 in the hood 9. The hood 9 also contains a yarn guide conduit 13, through which individualized fibers combed from a sliver (not shown) by an opening roller 15 in an opening device 14, are transported to the rotor 5. Feeding of the sliver to the opening roller 15 is performed by means of a delivery roller (not shown) having an axial extension 16 which projects from the housing of the opening device 14. The delivery roller is actuated by the service unit 2 during the process of piecing a yarn within the rotor 5 for controlling the feeding of the sliver.

The hood 9 additionally contains a tube 17 which, in the instant exemplary embodiment, terminates within the cup-like interior 5*a* of the rotor 5 in the spinning chamber 4. The tube 17 is used for supplying aspirated air or compressed air into the rotor 5 particularly for cleaning the rotor cup 5*a*. In accordance with the exemplary embodiment in German Patent Publication DE 196 24 537 A1, the tube 17 can also terminate in the yarn withdrawal tube 10 behind the yarn draw-off nozzle 11. An opening 18 at the opposite end of the tube 17 is disposed in an adapter 19 configured for receiving a compressed air nozzle 25, which can be advanced from the service unit 2. The adapter is set into a wall 20 of the hood 19 and, in accordance with the invention, is openable and closable by means of a slide member 21.

The opening and closing movements of the slide member 21 are actuated by the service unit 2. The service unit 2, not shown in detail, is movably seated on the frame of the spinning machine, as generally known within the art, for movement along the spinning stations 1 and, upon a yarn break or bobbin change, is operative to perform a yarn piecing operation. The service unit 2 is equipped with a manipulator 22 for this purpose. The manipulator 22, for example, has a drive 23 for the delivery roller, which can be coupled with the extension 16 thereof for feeding sliver during the piecing process.

The manipulator 22 is furthermore equipped to actuate the slide member 21, thereby to unblock the opening 18. In the instant exemplary embodiment, the manipulator 22 has an actuator 24 with a profiled element 51, which engages an actuating element 49 of the slide member 21. Upon opening of the slide member 21, air flows through the opening 18 into the tube 17 and thus into the rotor 5 and the spinning chamber 4. Prior to each yarn piecing operation, the rotor 5 and the spinning chamber 4 are purged of stray fibers in this manner. This manner of cleaning is known, for example, from German Patent Publication DE-OS 28 18 794. Cleaning of the rotor 5 can additionally be aided by blowing of compressed air into the spinning chamber. For this purpose, the manipulator 22 can be equipped with a compressed air nozzle 25, which is disposed to be placed against the opening 18 when unblocked by opening of the slide member 21. The nozzle 25 is connected with a compressed air source indicated only schematically by the symbol 26.

The manipulator 22 is pivotably mounted on the service unit 2. Two essentially parallel rocker arms 27 and 28 of equal length are seated at respective ends in hinges 29, 30 on the service unit 2 and support the manipulator 22 in hinges 31 and 32 on at opposite ends of the rocker arms 27, 28. The rocker arm 27 can be pivoted around the hinge 29 by means of a drive 33, as indicated schematically by the arrow 34. In this manner, it is possible to retract the manipulator 22 when the service unit 2 is moving, and to extend it for placement against a spinning station after the service unit has been positioned in front of a spinning station 1. Such movement takes place in an arc about a relatively large radius, as indicated by the arrow 35. The movements of the service unit 2, the movements of the manipulator 22 and the drive 23 for the delivery roller are controlled by a control device 36 in the service unit 2.

Figure 2:
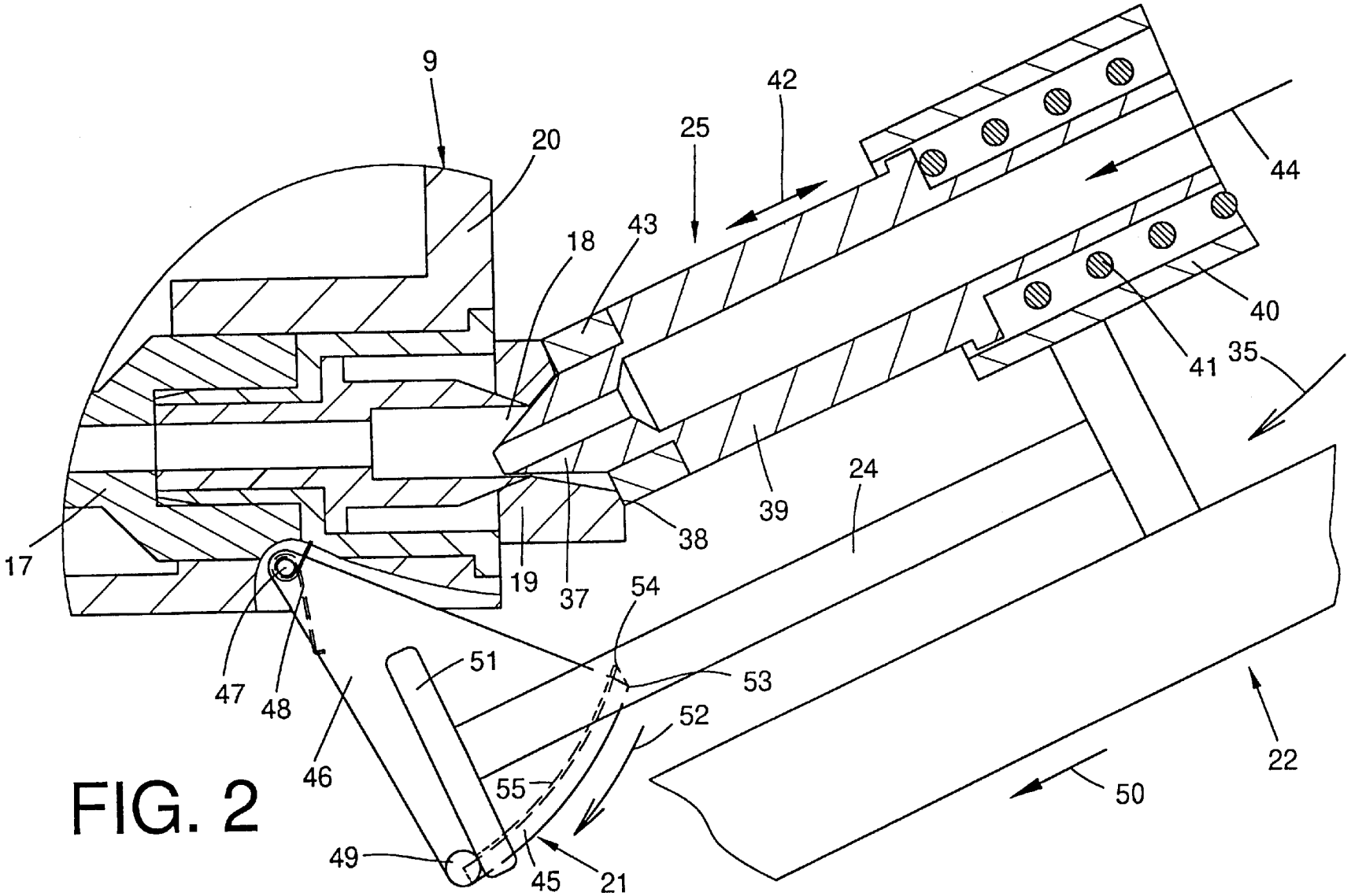
FIG. 2 is an enlarged cross-section of a portion of the spinning station of FIG. 1 in greater detail, showing the compressed air nozzle placed against the opening completely unblocked by the slide member.

FIG. 2 shows in a more detailed cross-section the slide member 21 completely opened to unblock the opening 18, with the compressed air nozzle 25 placed against the adapter 19 in the wall 20 of the hood 9 to extend into the opening 18. The adapter 19 is configured in a funnel-shape formed compatibly with a cone-shaped mouth 37 of the compressed air nozzle 25 for mated receipt thereof. As previously indicated, the tube 17 for supplying air to the rotor 5 is connected with the adapter 19. The annular rim 38 of the opening 18 serves as a detent for the mouth 37 of the compressed air nozzle 25, as well as a sealing face on which the slide member 21 rests when closed. The compressed air nozzle 25 consists of a tube 39, which tapers in the aforementioned cone-shape at the mouth 37. The nozzle tube 39 is displaceably seated telescopically in a further tube 40 against a biasing spring 41 therein. By means of this manner of spring-loaded telescopical mounting of the tube 39, it is possible to overcome path tolerances when advancing the manipulator 22, as indicated by the arrow 42. An annular seal ring 43 formed of an elastic material, for example rubber, is disposed about the end of the tube 39 adjacent the conical mouth 37 to engage against the sealing rim 38 of the adapter 19 in order to prevent the undesired exit of air at the opening 18. After the compressed air nozzle 25 has been placed against the adapter 19, a valve (not shown) is opened and, as indicated by the arrow 44, compressed air flows from the compressed air source 26 (FIG. 1) through the tube 39 into the tube 17.

The slide member 21 is configured to match the profile of the sealing rim 38 of the opening 18, and is curved into the form of a shield. A triangular piece 46 of sheet metal is pivoted at its apex on a shaft 47 arranged below the adapter 19 in the wall 20 of the hood 9 and the triangular piece 46 is fastened at the opposite side thereof on one of the narrow sides 45 of the slide member 21 to serve as a pivot lever for the slide member 21. The slide member 21 is normally kept in a closed position by a spring 48, which is fixed at one end to the hood 9 and at the other end to the pivot lever 46. An actuating element 49 is additionally arranged on the narrow side 45 of the slide member 21. In the instant exemplary embodiment, the actuating element 49 is a pin extending into the path of movement 50 of the profiled element 51 arranged on the forwardly projecting end of the slide actuator 24 of the manipulator 22. During the advancing movement of the manipulator 22, this profiled element 51 abuts against the actuating element 49 of the slide member 21 and pushes it in the open position illustrated in FIG. 2. In the process, the slide member 21 is pivoted in the direction of the arrow 52 around its pivot shaft 47, wherein the actuating element 49 slides along the actuating profile 51.

For cleaning the annular sealing face 38 formed around the opening 18 by the rim of the adapter 19, the slide member 21 has a tapered angular profile 54 on its leading edge, by means of which dirt, fibers stuck together by gummy or sticky residue, and dust, which have possibly been deposited on the sealing face 38, can be stripped off in the course of each closing movement of the slide member 21 in order to clean the sealing face 38.

In order to achieve a particularly good sealing of the opening 18 when the slide member 21 is closed, a diaphragm 55 is stretched across the side of the slide member 21 facing the opening 18. With the slide member 21 closed, the diaphragm 55 is pulled by the suction of the spinning vacuum prevailing at the opening 18 and is thereby held against the sealing face 38. In this way the opening 18 is effectively sealed during the spinning process, so that a possible admission of secondary air is prevented.

Figure 3:
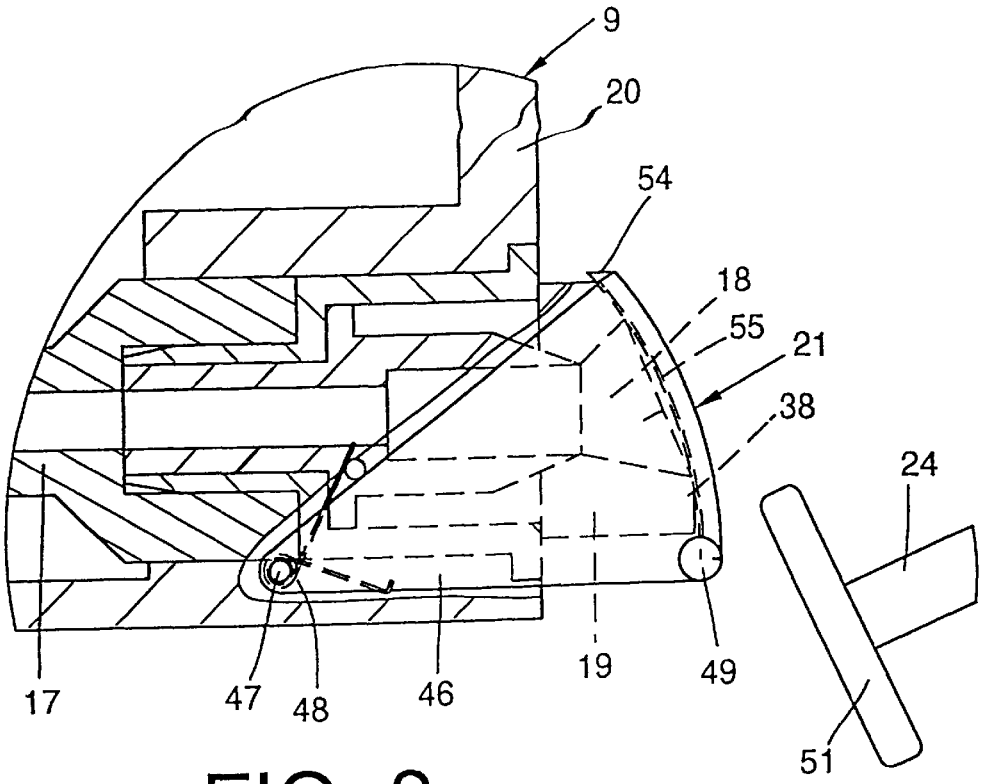
FIG. 3 is another cross-sectional view similar to FIG. 2, showing the opening with the slide member in the closed position.
Figure 4:
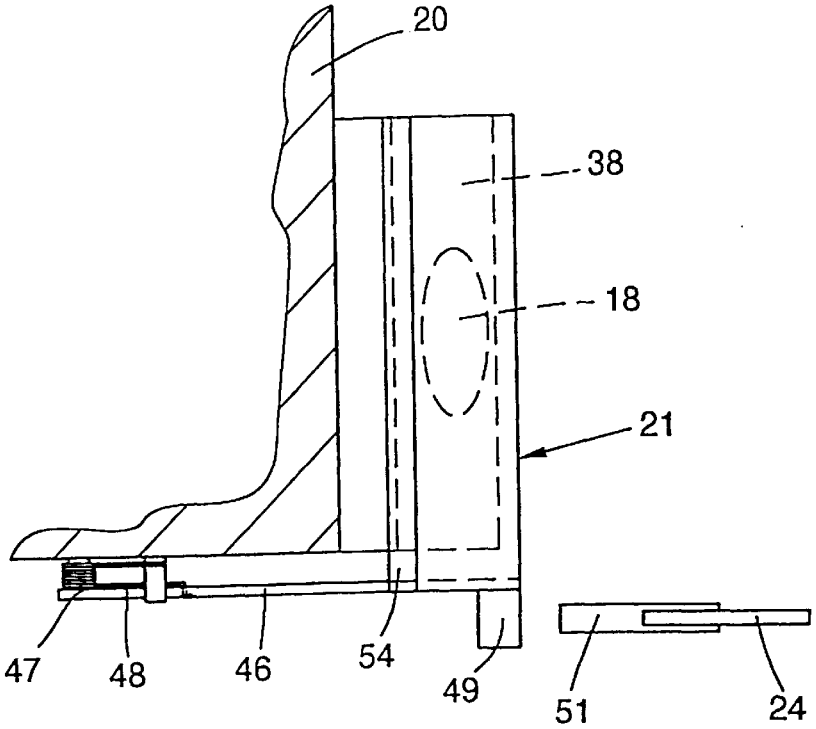
FIG. 4 is a partial top view of the opening and closed slide member of FIG. 2.

FIG. 3 shows the slide member 21 in the closed position in a lateral view, corresponding to FIGS. 1 and 2. FIG. 4 is a top view of the closed slide member 21. By means of the spring 48 and via the sheet metal piece 46 attached to the narrow side 45 of the slide member 21, the slide member is maintained in the closed position in front of the opening 18.

Figure 5:
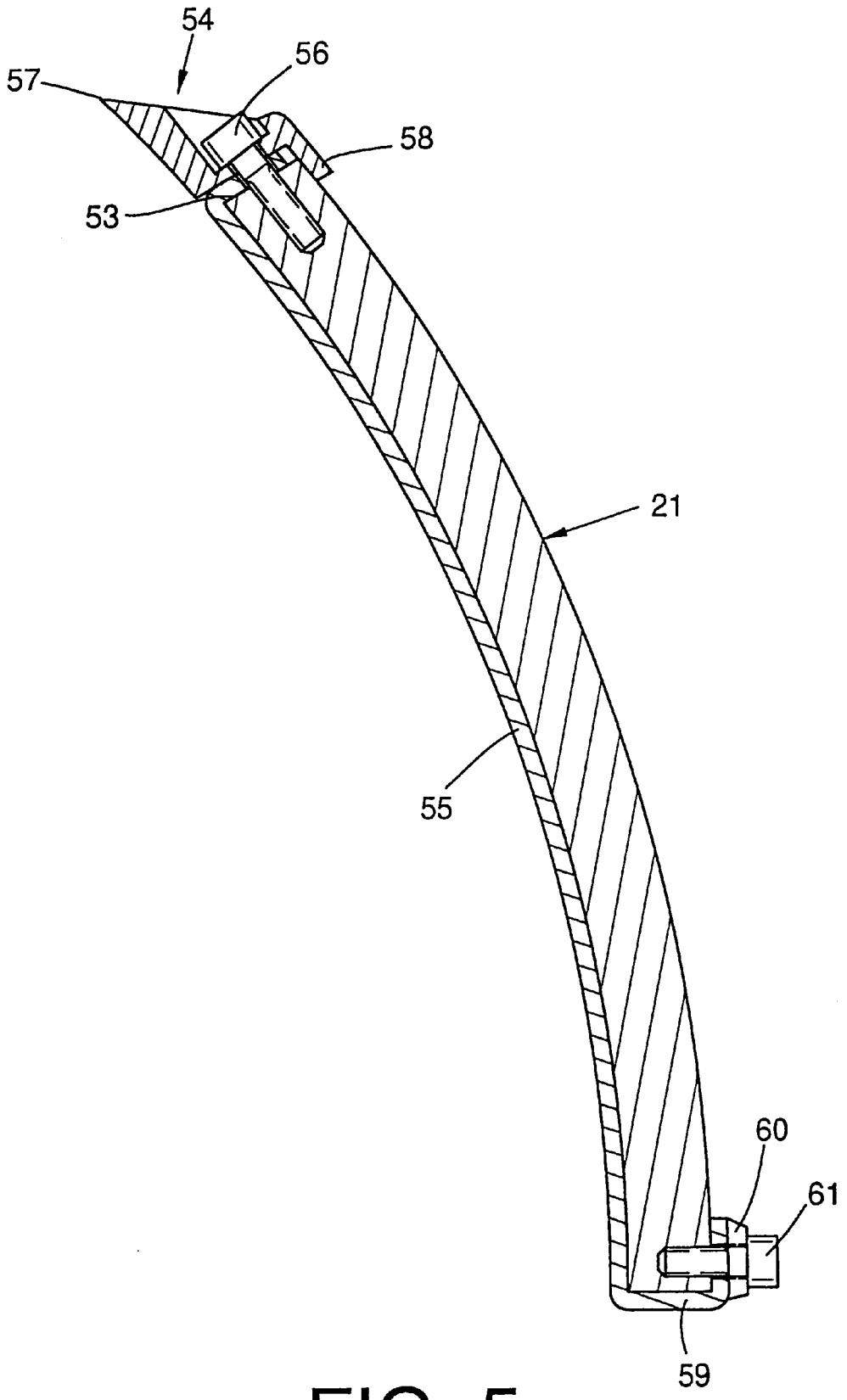
FIG. 5 is a longitudinal cross-sectional view of the slide member.

FIG. 5 shows the slide member 21 in detail. Since the angular edge profile 54 and the diaphragm 55 are wear elements, it is advantageous if these elements are exchangeably fastened on the slide member 21. To this end, the diaphragm 55 is placed around the front edge 53 of the slide member 21 and is clamped by the edge profile 54, which is fastened by screws 56 on the front edge 53. For example, the profile 54 can be made of plastic having a wedge-like tapering edge 57 for scraping off the dirt from the sealing face 38, and having a detent 58 for exactly fitted placement on the slide member 21. The diaphragm furthermore is extended around the lower edge 59 of the slide member 21 and, on its side facing away from the opening 18, is clamped by means of a retainer strip 60 fastened with screws thereat.

Figure 6:
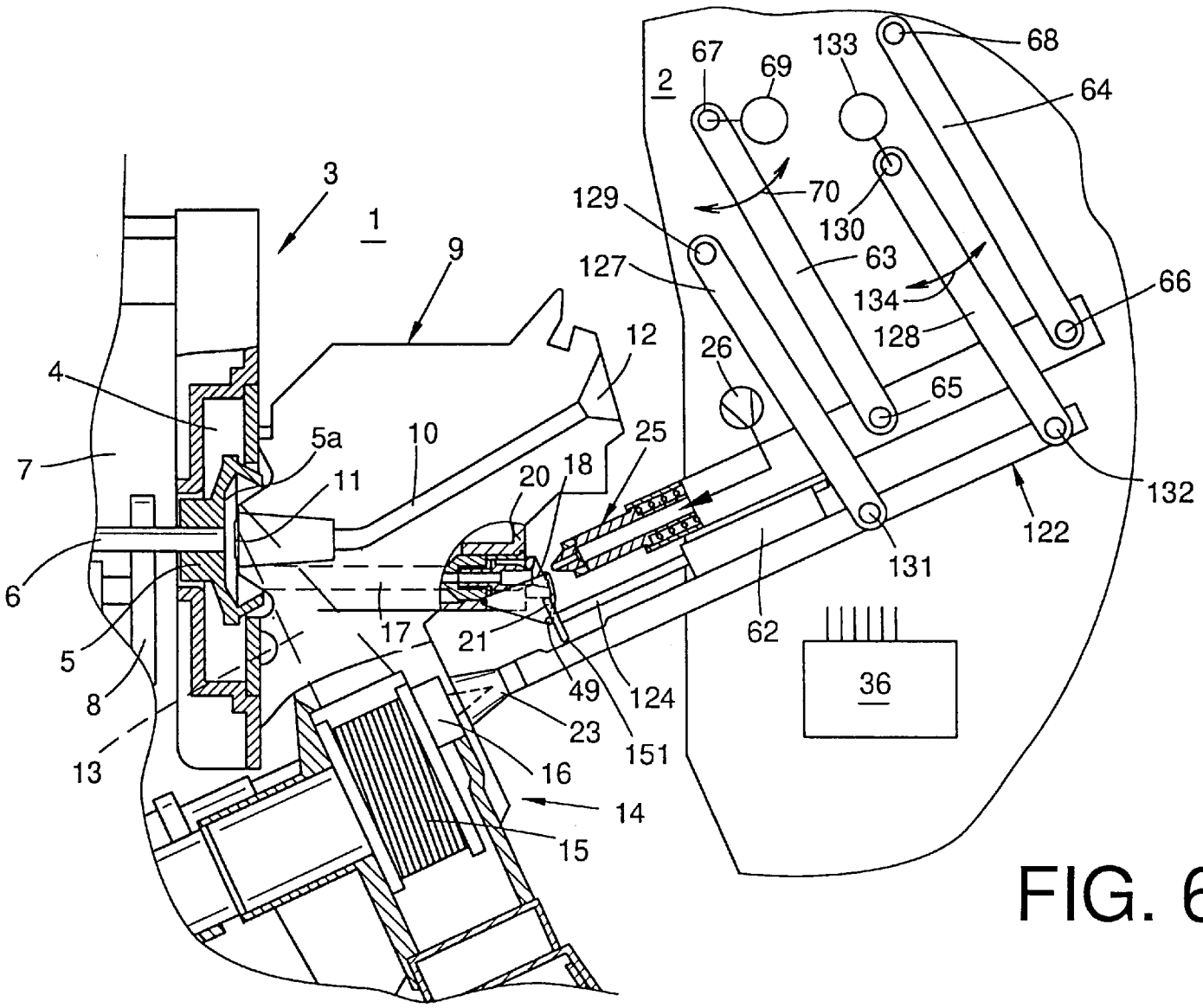
FIG. 6 is another side elevational view, partially in cross-section, similar to FIG. 1, of one spinning station of a multi-station open-end spinning machine with a service unit positioned at the front of the station to place a manipulator with a compressed air nozzle against the spinning box, depicting a second preferred embodiment of the present invention wherein the compressed air nozzle can be placed against the spinning station independently of the manipulator.

A variant of the arrangement of the manipulator, the actuator for the slide member and the compressed air nozzle is represented in FIG. 6. In contrast to the exemplary embodiment according to FIG. 1, the compressed air nozzle 25 can be advanced independently of the manipulator 122 by means of the drive of the draw-in roller. The characteristics agreeing with FIG. 1 are identified by the same reference numerals.

As in the exemplary embodiment in accordance with FIG. 1, the manipulator 122 is pivotably seated on two rocker arms 127 and 128 of the same length, with the rocker arm 127 seated in a hinge 129 in the service unit 2 supporting the manipulator 122 by a hinge 131 and the rocker arm 128 seated in a hinge 130 in the service unit 2 supporting the manipulator 122 in a hinge 132. A drive 133 arranged at the hinge 130 actuates pivoting of the rocker arm 128, as symbolized by the arrow 134, and in this manner allows the retraction of the manipulator 122 during the movement of the service unit 2 along the machine, and the extension of the manipulator 122 when the manipulator 122 has been positioned at a spinning station 1. The manipulator 122 supports the drive 23 for the draw-in roller and the actuator 124 for the slide member 21. However, in contrast to the exemplary embodiment in accordance with FIG. 1, the actuator 124 is not rigidly mounted on the manipulator 122 but instead is formed by the piston of a pneumatic cylinder 62. This pneumatic cylinder 62 is triggered by the control device 36 and therefore can engage the actuating element 49 of the slide member 21 with its profiled element 151, independently of the position of the manipulator 122.

The compressed air nozzle 25 is pivotably supported independently of the manipulator 122 on two rocker arms 63 and 64 of equal length on hinges 65, 66, respectively. The rocker arms 63 and 64 in turn are pivoted by hinges 67, 68, respectively, in the service unit 2. Thus, the compressed air nozzle 25 can be pivoted outwardly and inwardly, as indicated by the arrow 70, by means of a drive 69, to be placed against the opening 18 for supplying compressed air to the spinning chamber 4.

The ability for separate advancement of the compressed air nozzle 25 and the manipulator 122 represented in this exemplary embodiment has the advantage that, following cleaning of the rotor 5 and the spinning chamber 4, the compressed air nozzle 25 can be retracted into the position shown in FIG. 6, and that subsequently, for example at the time of feeding in the fibers by means of the delivery roller actuated by the drive 23, a controlled air supply through the tube 17 into the spinning chamber 4 and to the rotor 5 can be accomplished by a controlled movement of the actuator 124 to selectively adjust the position of the slide member 21 in respect to the opening 18. Such movement of the actuator 124 is controlled by the control device 36 by means of air supplied to the pneumatic cylinder 62. In the instant exemplary embodiment, the opening 18 is unblocked by the retracted compressed air nozzle 25 and is blocked about halfway by the slide member 21.

Figure 7:
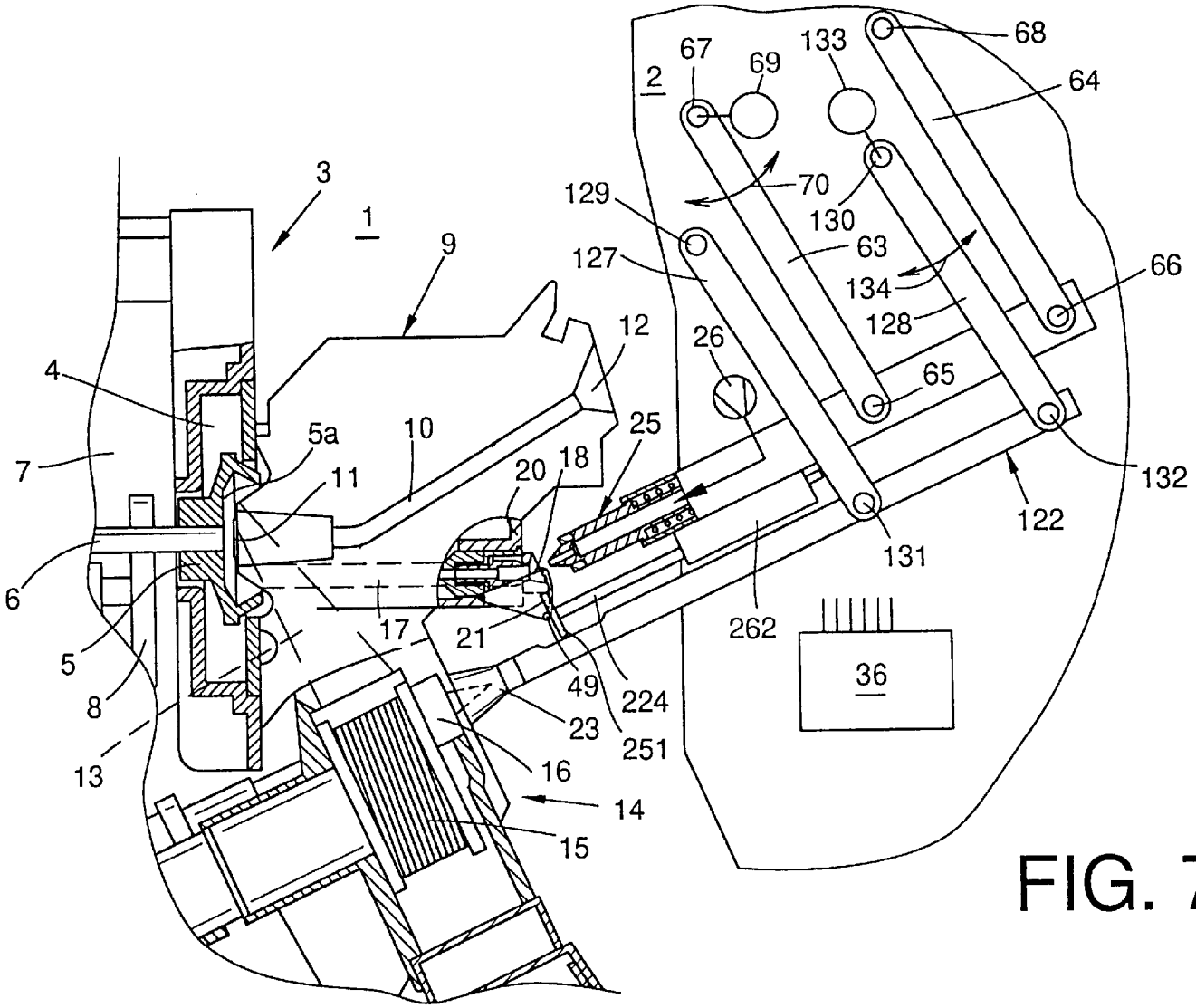
FIG. 7 is another side elevational view, partially in cross-section, similar to FIGS. 1 and 6, of one spinning station of a multi-station open-end spinning machine with a service unit positioned at the front of the station, wherein the compressed air nozzle has a profile for actuating the slide member.

The exemplary embodiment in accordance with FIG. 7 differs from the exemplary embodiments in accordance with FIGS. 1 and 6 in that the compressed air nozzle 25 itself carries a profiled element 251 for actuating the slide member 21. This profiled element 251 is constituted by the end of an actuator 224 which is advanced into operative connection with the actuating element 49 of the slide member 21. If the actuator 224 is rigidly arranged on the compressed air nozzle 25, the opening position of the slide member 21 depends on the advancing movement of the compressed air nozzle 25. In the exemplary embodiment of FIG. 7, as in the exemplary embodiment of FIG. 6, the actuator 224 is the piston of a compressed air cylinder 262 whereby the slide member 21 can be actuated when the compressed air nozzle 25 has withdrawn from the opening 18. The compressed air cylinder 262 can be triggered by means of the control device 36 in such a way that the slide member 21 can be placed into predeterminable opening positions by the actuator 224.

It is also conceivable, but not shown, that no compressed air nozzle 25 is provided. Cleaning of the rotor and the spinning box then takes place exclusively by unblocking of the opening 18 by the slide member 21. In such a case the unblocking of the opening 18 is performed by a controlled movement of the actuator 124 by means of its own drive and without it being necessary to move the manipulator 122 for this purpose.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. In a spinning station of an open-end spinning machine, a spinning box comprising a spinning chamber, means for applying a spinning vacuum within the chamber, a rotor disposed rotatably within the chamber, and a cover enclosing the spinning chamber, the cover having means for feeding fibers to the rotor, means for withdrawing spun yarn out of the rotor, an opening for supplying air into the chamber, and a slide member for opening and closing the air supplying opening during a yarn piecing operation by means of a service unit for performing the piecing operation.

2. The spinning box in accordance with claim 1, wherein the service unit includes a manipulator having a profiled element movable relative to the spinning station and the slide member includes an actuating element disposed in the path of movement of the profiled element so that the opening and closing disposition of the slide member can be changed as a function of the movement of the profiled element.

3. The spinning box in accordance with claim 2, wherein the profiled element comprises a selectively actuable actuator.

4. The spinning box in accordance with claim 1, wherein the slide member comprises a leading edge configured for cleaning the opening during closing movement of the slide member.

5. The spinning box in accordance with claim 4, wherein the leading edge is exchangeably attached to the slide member.

6. The spinning box in accordance with claim 1, wherein the slide member comprises a diaphragm for covering the opening in its closed disposition.

7. The spinning box in accordance with claim 1, wherein the slide member is connected with a device for urging the slide member into the closed position.

8. The spinning box in accordance with claim 1, wherein the opening is configured for receiving a compressed air nozzle when unblocked by the slide member.

9. The spinning box in accordance with claim 8, wherein the service unit comprises the compressed air nozzle and the nozzle has a profiled element for actuating the slide member.

* * * * *